United States Patent [19]

Starling

[11] Patent Number: 4,625,338

[45] Date of Patent: Dec. 2, 1986

[54] LADIES' RESILIENT GARMENT FOR SMOOTHING ARM FLABBINESS

[76] Inventor: LaFerne L. Starling, 4475 49th St. #101, San Diego, Calif. 92115

[21] Appl. No.: 731,022

[22] Filed: May 6, 1985

[51] Int. Cl.[4] ..... A41D 19/00

[52] U.S. Cl. ..... 2/106; 2/16; 2/59

[58] Field of Search ..... 2/16, 59, 106, 90, 91, 2/108

[56] References Cited

U.S. PATENT DOCUMENTS

| | | | |
|---|---|---|---|
| 2,799,023 | 7/1957 | Goodman | 2/78 R |
| 3,909,851 | 10/1975 | Garrou et al. | 2/224 |
| 4,016,027 | 4/1977 | Kintanar | 128/77 |
| 4,369,528 | 1/1983 | Vest et al. | 2/90 |

*Primary Examiner*—Doris L. Troutman
*Attorney, Agent, or Firm*—George J. Rubens

[57] ABSTRACT

A ladies' garment is provided for the purpose of smoothing the wrinkles and flabbiness in the skin and muscles of the forearm and upper arm to improve appearance, primarily when wearing sleeveless dresses and blouses. The garment is made of a two-way resilient stretchable sheer fabric, and consists of a waist encircling portion connected to a pair of spaced extending arm portion. The arm portions can extend to the wrist and hidden from view by wearing of a bracelet or the like. The wrist portion can be provided with separable segments for adjusting the length. The other end of the arm portions extend to the shoulders for applying a tension to maintain the arm portions in position. The garment is designed as to not be visible from the front or rear of the wearer.

8 Claims, 6 Drawing Figures

LADIES' RESILIENT GARMENT FOR SMOOTHING ARM FLABBINESS

BACKGROUND OF THE INVENTION

This invention relates to ladies' garments, and more particularly to such a garment that is capable of smoothing any flabbiness and wrinkles appearing on a lady's arm, which is unattractive and detracts from her appearance.

It is natural for skin flabbiness and wrinkles to develop in the upper arms and forearms of a person due to muscle aging and excess weight, which conditions in a woman is most unattractive, especially when wearing sleeveless garments. Other than surgical means, the only alternative at the present time was to hide such a physical condition by wearing long sleeve garments which is a limiting factor to a woman's wardrobe.

The present invention is able to smooth out arm flabbiness by use of a novel garment that appears so natural as to be practically unnoticeable. In addition to improved appearance, the unique garment has a tendency to firm up the skin and muscles, much like the support provided by a typical brassiere.

BRIEF SUMMARY OF THE INVENTION

A ladies' undergarment is provided for smoothing out the wrinkles and flabbiness in the arms and forearms that invariably appear due to muscle aging and overweight conditions. The garment consists of a pair of spaced arm portions connected to and extending from a waist encircling portion. The arm portions perferably extend from the wrist of each arm to over the shoulder of the wearer to anchor the arm portion in position. In the prefered embodiment, the arm portions and the waist portion are made integral in one piece, and of a resilient two-way stretch knit material, much like a hosiery material. When the material is of a sheer weight and flesh color, its presence when worn is practically unnoticeable. The arm portions of the garment are joined to the waist portion in such a manner so as to avoid crossing the body of the wearer, either in front or back, to conceal its presence. The wrist section of the garment arms may have separable end sections to enable the garment to be tailored to the arms of the wearer. In view of the high degree of fabric stretchability, one size garment will accommodate a number of dress sizes.

OBJECTS OF THE INVENTION

A principle object of this invention is to provide a ladies' garment that will smooth out the flabbiness and wrinkles that may exists in the arm of the user.

Another important object is to provide such a garment made of a sheer, skin color material so as to be unnoticeable when worn.

Still another important object is to provide such a garment that is made in one piece, and which can be compactly stored in a woman's purse.

DRAWINGS OF THE INVENTION

DETAILED DESCRIPTION OF THE INVENTION

Figure 1:
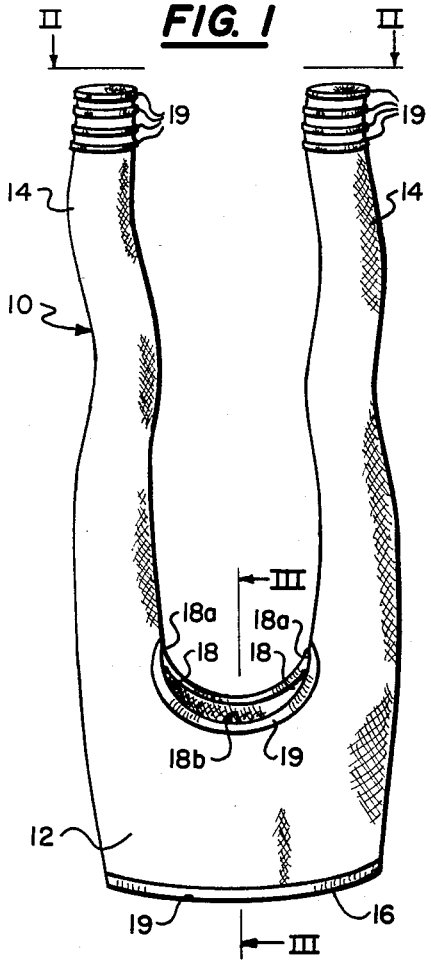
FIG. 1 is a front or rear elevation view of the novel ladies garment extended but in a relaxed condition.
Figure 2:
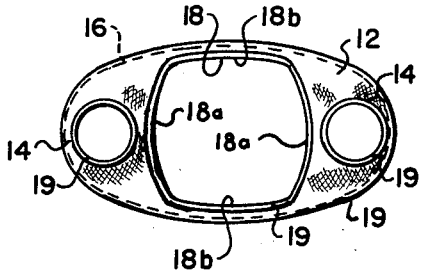
FIG. 2 is a top view of the garment in FIG. 1 taken along line II—II.

Referring to the drawing where like references refer to similar parts throughout the figures, there is shown in FIG. 1 a front or rear elevation view of the novel ladies garment 10 in an extended and relaxed condition. Garment 10 comprises a waist portion 12 and a pair of spaced arm portions connected to and extending from the waist portion 12 in a manner to be described.

Waist portion 12 and both arm portions 14 are made of a resilient two-way stretch material to enable the garment to be pulled over to snugly fit and compress the corresponding body portions of the wearer. In the preferred embodiment, if the garment is to be worn for social occasions or the like, the best material is a sheer, knit material having a flesh color to simulate the color of the skin so as not to be readily noticeable when worn.

To simplify the manufacture of the garment, the arm and waist portions can best be fabricated in one piece by a conventional knitting process, such as is used in manufacturing ladies' hosiery.

Figure 5:
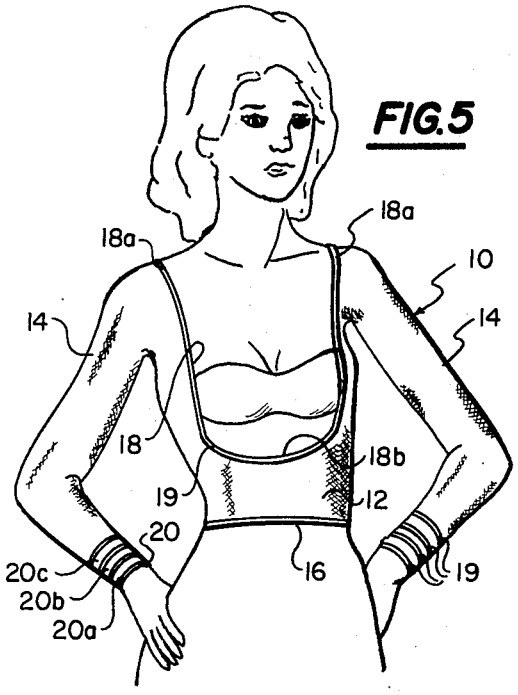
FIGS. 5 and 6 are front and rear elevations view, respectively, of the novel garment stretched over the waist and arms of a wearer.
Figure 6:
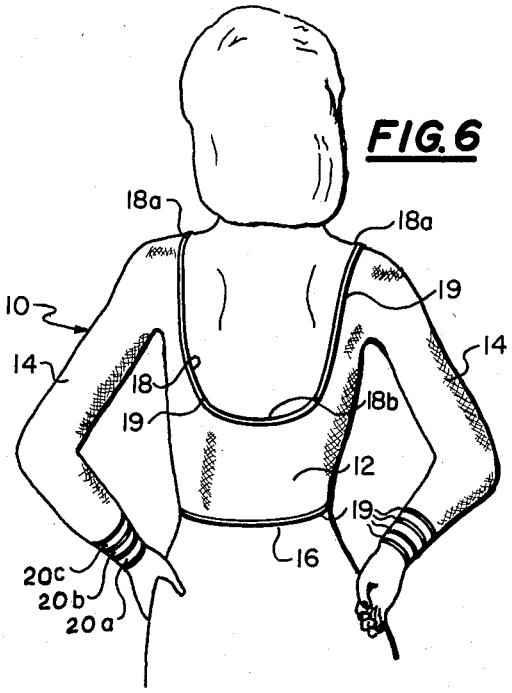
Figure 3:
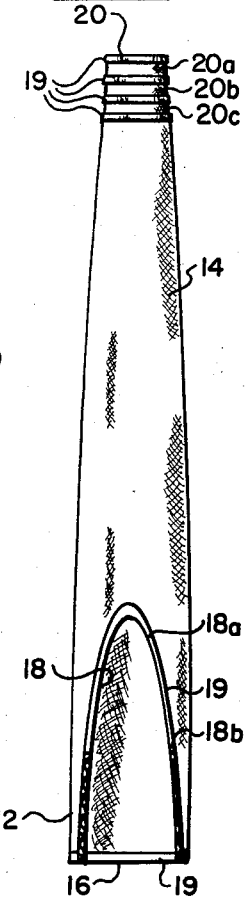
FIG. 3 is a longitudinal cross section of the garment taken along line III—III of FIG. 1.

The bottom end of waist portion 12 has a lower opening 16, and the top end of the waist portion has an upper opening 18. As best seen in FIG. 3, upper opening 18 extends upwardly into the lower portion of each arm portion, for a purpose to be described. Both openings 16 and 18 are sufficiently large when stretched to receive the waist of the user, as shown in FIGS. 5 and 6. Openings 16 and 18, as well as all edges, are finished with an elastic seam 19.

If the garment 10, as shown in FIG. 1 is to be compared to a pair of inverted slacks, upper opening 18 is located at the crotch area, with side ends 18*a* of opening 18 extending upwardly into each of the lower arm portions forming opening 18 into a u-shaped configuration when viewed from the front or rear of the garment (see FIG. 1). When the garment is stretched over the user's body, the side ends 18*a* are designed to fit over the respective shoulders in a manner to be described. Front and rear ends 18*b* of opening 18 extend across the lower stomach area of the wearer, and the back area well below the usual dress line so as to be invisible.

A top view of opening 18, as best seen in FIG. 1, shows the opening to be symmetrical so that the front and rear sides are substantially identical (FIGS. 5 and 6) making the garment reversible. In addition, the configuration of opening 18 is designed not to interfere with the wearing of a brassiere, and not be visible when wearing low cut dresses.

Figure 4:
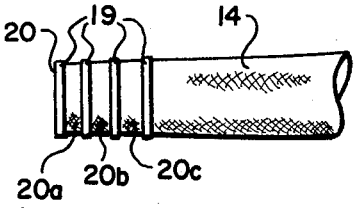
FIG. 4 is an enlarged view of the wrist section of one the arm portions showing the separable sections.

Because of the high degree of stretchability of the preferred material, one size garment will accommodate a number of different dress sizes. Variations in arm lengths in accounted for by providing the wrist ends of the arm portions 14 with a series of adjacent separable segments, i.e. 20*a*, 20*b*, and 20*c* (see FIG. 4), each of which segments can be individually severed by a scissors. Each segment is also finished with an elastic seam 19.

Garment 10 can be applied to the body of the wearer by pulling the garment over the head through opening 16, or more likely by stepping into opening 18, whichever is easier for the wearer. There is no need for concern as to which is the front or back as both are substantially identical. With the the waist portion 12 snugly positioned around the waist of the wearer, she then inserts her arms into arm portions 14 gently stretching the material in the process. The garment material at end opening 18*a* are then pulled over the respective shoulders which stretches arm portions over the arms of the wearer to provide a snug fit to smooth out the flabbiness that may be present. It should be noted that the shoulders of the wearer tend to anchor the arm portions and keep them taut. Assuming the wearer has chosen the correct size garment, the resiliency of the fabric gently compresses and smooths the skin of the arms, and incidently compresses the waist of the wearer. With a flesh color material, the garment blends with the skin and is unnoticeable.

In addition to smoothing out the flabbiness in the wearer's arm, the novel ladies' garment of this invention because of its elasticity will provide an aid to circulation in the arms by its resilient support, and will contribute generally to a snug feeling of well-being.

I claim:

1. A ladies' garment for smoothing the wrinkles and flabbiness in the arms and waist of a wearer, said garment comprising;

a waist encircling section;

a pair of spaced arm sections connected to the waist section to form a U-shaped back opening to enable the wearing of a backless garment;

the material of said arms and waist sections being made of a two-way stretchable material;

said waist section having an opening sufficiently large to be stretchable over the body of the wearer to encircle the waist area; and said arm sections extending over the shoulders of the user for applying a tension on said arm sections to maintain them in a snug position around the arms of the wearer.

2. The ladies' garment of claim 1 wherein said arm sections have a wrist terminating end and a shoulder engaging end.

3. The ladies' garment of claim 1 wherein the edges of said waist and arm sections terminate in a stretchable seam.

4. The ladies' garment of claim 1 wherein the arm sections and the waist section are made of the same piece of sheer and elastic knit material.

5. The ladies' garment of claim 2 wherein said wrist end has a plurality of laterally disposed seamed separable segments to enable the length of the arm section to be adjusted to the arm length of the wearer.

6. The ladies' garment of claim 4 wherein the front and rear sides of the garment are substantially identical U-shaped openings.

7. A ladies' garment for smoothing the wrinkles and flabbiness in the arms and waist of a wearer comprising;

a waist encircling portion having an upper rear U-shaped opening to enable the wearing of a backless dress and a lower circular opening;

a pair of spaced arm portions integrally connected to the waist portion adjacent said upper opening in the waist portion, said waist and arm portions being fabricated of the same piece of resilient two-way stretchable material;

said arm portions having a wrist end and a shoulder engaging end;

whereby when the garment is stretched over the arms and waist of the wearer, the shoulder engaging ends of the arm portions will apply a tension on the arm portions to snugly engage the arms of the wearer.

8. The ladies' garment of claim 7 wherein said material is a sheer knit fabric having a skin color and the front and back of the garment has U-shaped openings extending between the waist and arm portions to enable the wearing of low cut dresses without the garment being visible.

* * * * *